United States Patent [19]

Nash

[11] 4,069,395

[45] Jan. 17, 1978

[54] ANALOG DEREVERBERATION SYSTEM

[75] Inventor: Donald Henry Nash, Colts Neck, N.J.

[73] Assignee: Bell Telephone Laboratories, Incorporated, Murray Hill, N.J.

[21] Appl. No.: 791,416

[22] Filed: Apr. 27, 1977

[51] Int. Cl.[2] ..... G10L 1/00; H04R 3/00

[52] U.S. Cl. ..... 179/1 P; 179/1 SA

[58] Field of Search ..... 179/1 SA, 1 P

[56] References Cited

U.S. PATENT DOCUMENTS

| | | | |
|---|---|---|---|
| 3,440,350 | 4/1969 | Flanagan | 179/1 SA |
| 3,644,674 | 2/1972 | Mitchell | 179/1 P |
| 3,794,766 | 2/1974 | Cox | 179/1 P |

*Primary Examiner*—Kathleen H. Claffy
*Assistant Examiner*—E. S. Kemeny
*Attorney, Agent, or Firm*—Henry T. Brendzel

[57] ABSTRACT

Room reverberation characteristic of monaural systems is removed, in accordance with the principles of this invention, by employing two microphones at the sound source and by manipulating the signals of the two microphones to develop a single nonreverberant signal. Both early echoes and late echoes in the signal received by each microphone are removed by manipulating the signals of the two microphones in separate frequency bands of the signal. Corresponding frequency bands of the two signals are co-phased and added and the magnitude of each resulting frequency band is modified in accordance with a computed phase difference average between the corresponding frequency bands. The modified frequency bands are combined, thereby forming the nonreverberant signal.

9 Claims, 5 Drawing Figures

ANALOG DEREVERBERATION SYSTEM

BACKGROUND OF THE INVENTION

1. Field of the Invention

This invention relates to signal processing systems and, more particularly, to systems for reducing room reverberation effects in audio systems such as those employed in "hands free telephony."

2. Description of the Prior Art

It is well known that room reverberation can significantly reduce the perceived quality of sounds transmitted by a monaural microphone to a monaural loudspeaker. This quality reduction is particularly disturbing in conference telephony where the nature of the room used is not generally well controlled and where, therefore, room reverberation is a factor.

Room reverberations have been heuristically separated into two catergories: early echoes, which are perceived as spectral distortion and their effect is known as "coloration," and longer term reverberations, also known as late reflections or late echoes, which contribute time-domain noise-like perceptions to speech signals. An excellent discussion of room reverberation principles and of the methods used in the art to reduce the effects of such reverberation is presented in "Seeking the Ideal in 'Hands-Free' Telephony," Berkley et al., *Bell Labs Record,* November 1974, page 318, et seq. Therein, the distinction between early echo distortion and late reflection distortion is discussed, together with some of the methods used for removing the different types of distortion. Some of the methods described in this article, and other methods which are pertinent to this disclosure, are organized and discussed below in accordance with the principles employed.

U.S. Pat. No. 3,786,188, issued Jan. 15, 1974, described a system for synthesizing speech from a reverberant signal. In that system, the vocal tract transfer function of the speaker is continuously approximated from the reverberant signal, developing thereby a reverberant excitation function. The reverberant excitation function is analyzed to determine certain of the speakers's parameters (such as whether the speaker's function is voiced or unvoiced), and a nonreverberant speech signal is synthesized from the derived parameters. This synthesis approach necessarily makes approximations in the derived parameters, and those approximations, coupled with the small number of parameters, cause some fidelity to be lost.

In "Signal Processing to Reduce Multipath Distortion in Small Rooms," *The Journal of the Acoustics Society of America,* Vol. 47, No. 6 (Part I), 1970, pages 1475 et seq. J. L. Flanagan et al describe a system for reducing early echo effects by combining the signals from two or more microphones to produce a single output signal. In accordance with the described system, the output signal of each microphone if filtered through a number of bandpass signals occupying contiguous frequency ranges, and the microphone receiving greatest average power in a given frequency band is selected to contribute that signal band to the output. The term "contiguous bands" as used in the art and in the context of this disclosure refers to nonoverlapping bands. This method is effective only for reducing early echoes.

In U.S. Pat. No. 3,794,766, issued Feb. 26, 1974, Cox et al. describe a system employing a multiplicity of microphones. Signal improvement is realized by equalizing the signal delay in the paths of the various microphones, and the necessary delay for equalization is determined by time-domain correlation techniques. This system operates in the time domain and does not account for different delays at different frequency bands.

In U.S. Pat. No. 3,662,108, issued on May 9, 1972, to J. L. Flanagan, a system employing cepstrum analyzers responsive to a plurality of microphones is described. By summing the output signals of the analyzers, the portions of the cepstrum signals representing the undistorted acoustic signal cohere, while the portions of the cepstrum signals representing the multipath distorted transmitted signals do not. Selective clipping of the summed cepstrum signals eliminates the distortion components, and inverse transformation of the summed and clipped cepstrum signals yields a replica of the original nonreverberant acoustic signal. In this system, again, only early echoes are corrected.

Lastly, in U.S. Pat. No. 3,440,350, issued Apr. 22, 1969, J. L. Flangan describes a system for reducing the reverberation impairment of signals by employing a plurality of microphones, with each microphone being connected to a phase vocoder. The phase vocoder of each microphone develops a pair of narrow band signals in each of a plurality of contiguous narrow analyzing bands, with one signal representing the magnitude of the short-time fourier transform, and the other signal representing the phase angle derivative of the short-time Fourier transform. The plurality of phase vocoder signals are averaged to develop composite amplitude and phase signals, and the composite control signals of the plurality of phase vocoders are utilized to synthesize a replica of the nonreverberant acoustic signal. Again, in this system only early echoes are corrected.

In all of the techniques described above, the treatment of early echoes and late echoes is separate, with the bulk of the systems attempting to remove mostly the early echoes. What is needed, then, is a simple approach for removing both early and late echoes.

Such a simple approach is disclosed in a copending application Ser. No. 791,418 entitled "A Method and Apparatus for Removing Room Reverberation," filed by J. B. Allen. In accordance with the Allen disclosure, room reverberation characteristic of monaural systems is removed by employing two microphones at the sound source and by manipulating the signals of the two microphones to develop a single nonreverberant signal. Both early echoes and late echoes in the signal received by each microphone are removed by manipulating the signals of the two microphones in the frequency domain. Corresponding frequency samples of the two signals are co-phased and added and the magnitude of each resulting frequency sample is modified in accordance with the computed cross-correlation between the corresponding frequency samples. The modified frequency samples are combined and transformed to form the nonreverberant signal.

This Allen approach is simplified somewhat, and the apparatus embodying some of the principles in the Allen approach is made less expensive by the improvements of this invention.

SUMMARY OF THE INVENTION

In accordance with the principles of this invention, room reverberation is removed by employing two microphones at the sound source and by manipulating the signals of the two microphones to develop a single nonreverberant signal. Both early echoes and late echoes are removed by performing a co-phase and add operation in separate frequency bands of the signal and by modifying each frequency band resulting from the co-phase and add operation in accordance with a computed phase difference average between the corresponding frequency bands. The modified frequency bands are combined to form the nonreverberant signal.

DETAILED DESCRIPTION

In accordance with the Allen disclosure, room reverberation can be reduced by applying the equation $$S(\omega) = [Y(\omega) + A(\omega)X(\omega)]G(\omega) \quad (1)$$

to the signals of two microphones situated in a reverberant room, where $X(\omega)$ is the spectrum of the signal $x(t)$ of a first microphone, $Y(\omega)$ is the spectrum of the signal $y(t)$ of a second microphone, $A(\omega)$ is a frequency dependent phasor, and $G(\omega)$ is a frequency dependent gain control factor. This $S(\omega)$ signal, transformed into the time domain, is approximated in accordance with the principles of this invention by operating on a plurality of frequency bands rather than on the spectrum signals. Thus, an approximation to $s(t)$, $s'(t)$, which is the inverse function of $S(\omega)$ may be realized by $$s'(t) = \sum_{i=1}^{N} [y_i(t) + x_i(t + a_i)]g_i(t). \quad (2)$$

In equation (2), $x_i(t)$ is the first microphone's signal filtered through bandpass filter $i$, $y_i(t)$ is the second microphone's signal filtered through bandpass filter $i$, $a_i$ is the delay imposed on the signal $x_i(t)$, and $g_i(t)$ is a control signal developed from the signals $x_i(t+a_i)$ and $y_i(t)$ which relates to the phase difference variations between the component signals. The various filters ($i$ = 1,2,. . . N) may or may not be of equal bandwidth but they do cover the full frequency bandwidth of the signals developed in the two microphones.

Figure 1:
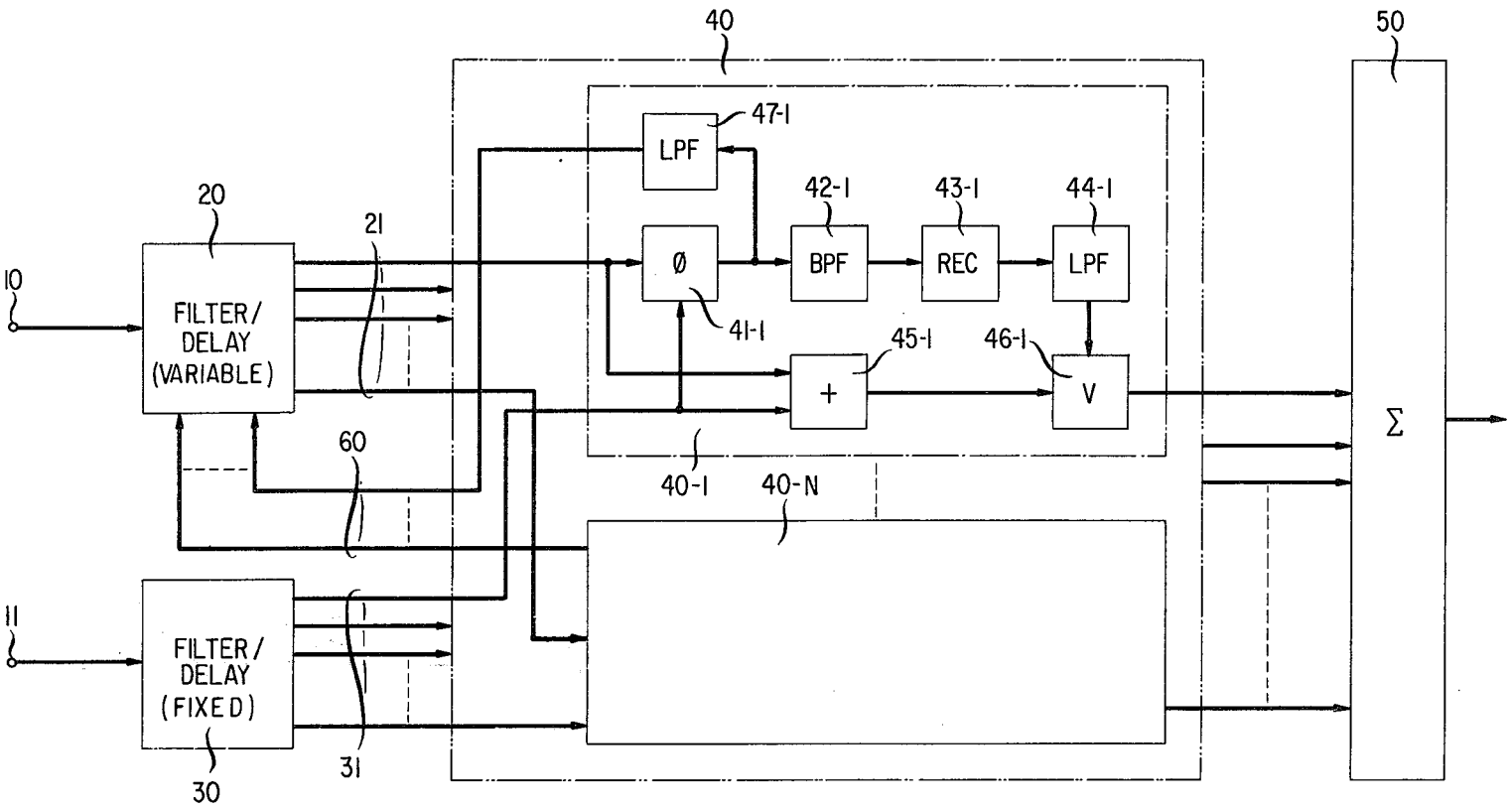
FIG. 1 illustrates the schematic diagram of a dereverberation system embodying the principles of this invention.

One system embodiment realizing the approximation defined by equation (2) is shown in FIG. 1, where the signal of a first microphone is applied through terminal 10 to filter/delay element 20 and the signal of a second microphone is applied through terminal 11 to filter/-delay element 30. Filter/delay element 20 provides a variable delay in response to control signals on bus 60, while filter/delay element 30 provides a fixed delay. The fixed delay developed by element 30 permits both positive and negative delay in the signal output of element 20 with respect to the signal output of element 30.

Filter/delay element 20 separates the spectrum of the signal applied to terminal 10 into a plurality of bands covering the entire spectrum of the signal and applies a delay to the signal of each band. The bands may overlap and the delay in each band may be related or unrelated to the delay in other bands. Filter/delay element 30 performs the same function as filter delay element 20 and is of the same construction, except insofar as it employs no means for developing a variable delay.

The plurality of bandpass signals developed by elements 20 and 30 are applied to signal combiner circuit 40 which develops an equal plurality of equalized bandpass signals. By "equalized" it is meant that corresponding bandpass signals (covering the same frequency band) developed in elements 20 and 30, forming pairs of bandpass signals, are co-phased and added, and the magnitude of the co-phased and added signal is modified; all in accordance with equation (2). This is illustrated in FIG. 1 by the drawing of correlator element 40-1 which is one of N identical elements in signal combiner circuit 40, where N is the number of bandpass signals developed by filter/delay element 20.

In accordance with one embodiment for correlator element 40-1, as shown in FIG. 1, the first pair of bandpass signals are applied to the first correlator circuit, wherein a measure of the correlation between the two applied signals is obtained by measuring the phase difference between the two signals. When two signals are delayed from one another but are otherwise well correlated, the correlation function (as a function of the classical variable $\tau$) is maximum at some value of $\tau$ other than zero (which corresponds to the delay between the two signals). To determine whether two signals are correlated, it is not important to know the value of $\tau$ where the correlation function is maximum but rather, the variability of $\tau$.

The measure of phase difference between two signals behaves as the correlation function. When the signals are highly uncorrelated, the phase difference is a rapidly varying signal and when the signals are perfectly correlated, the phase difference is an unvarying signal. Thus, a measure of the variability in the phase difference signal provides a measure of the correlation between the two measured signals and, accordingly, a measure of the energy in some preselected frequency band of the phase difference signal indicates the measure of correlation.

Therefore in accordance with the principles of this invention, a phase difference signal is developed in phase detector 41-1 and is passed through bandpass filter 42-1. The power in the signal at the output of bandpass filter 42-1 is determined with rectifier circuit 43-1 followed by a low-pass filter circuit 44-1 and that developed power serves as the measure of correlation between the applied signals.

Filter 42-1 is a bandpass filter, e.g., 1 Hz to 100 Hz, rather than a low-pass filter because fixed or very slow changes in phase (e.g., movements in the speaker's head) provide only a measure of the value of $\tau$ where the correlation function is maximum but do not provide a measure of the variability of $\mu\tau$. Thus, such slow phase changes (or fixed dc phase differences) are not really of interest. Precisely because of those reasons, the output signal of phase detector 41-1, passed through a low-pass filter 47-1 with a 1 Hz cutoff frequency, serves as one control signal of bus 60 which is fed back to and affects filter/delay element 20 to control the delay applied to the signal of terminal 10. By operation of this control signal, the bandpass signals applied to correlator element 40-1 are co-phased. The addition of the co-phased signals applied to correlator 40-1 is accomplished in adder circuit 45-1 which is responsive to the two applied bandpass signals. The co-phased and added output signal of adder 45-1 is modified to reduce the effects of reverberation by effectively multiplying the co-phased and added signal by the output signal of low-pass filter 44-1 which, as indicated above, provides a measure of the correlation in the signals applied to the correlator element. Thus, when correlation is high, the multiplier factor in the multiplication process is large and the output is large thereby accentuating nonreverberant signals, and when correlation is low, the multiplier factor is small and the output is small thereby attenuating reverberant signals. The multiplication process is achieved in element 46-1 which is responsive to element 44-1 and 45-1. Element 46-1 may be an analog multiplier circuit, a variolosser, or the like.

The output signal of element 46-1, which is also the output signal of correlator 40-1, is a bandpass signal occupying essentially the same band that its component signals occupy. The output signal of correlator 40-1 comprises one of the elements in the summation equation of equation 2, and comprises one of the output signals of signal combiner 40. The other output signals of correlator elements 40-2, . . . 40-N, are also bandpass signals occupying essentially the same bands as their component signals and, together, the signals from the correlation elements form the desired nonreverberant signal. The addition of these signals is performed in summer circuit 50. Summer 50 may be a conventional summing circuit comprising, for example, a plurality of resistors each connected to a different output signal of signal combiner 40 and to an input terminal of an operational amplifier of preselected gain.

Figure 2:
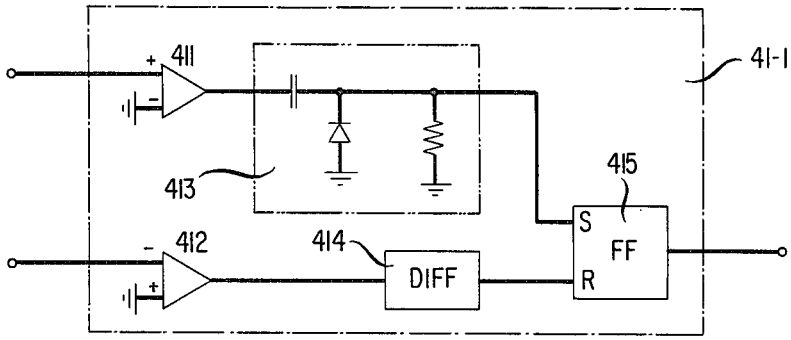
FIGS. 2 and 5 depict alternate embodiment for phase detector 41-1 in the system of FIG. 1.

One simple implementation for phase detector circuit 41-1 is shown in FIG. 2. Therein, amplifier 411 (providing positive gain) is responsive to one of the signals applied to phase detector 41-1 and amplifier 412 (providing a negative gain) is responsive to the other signal applied to detector 41-1. The signals applied to each amplifier are amplified to the point of amplifier saturation, causing the amplifier output signals to be square waves. The square wave signals of amplifiers 411 and 412 are differentiated in elements 413 and 414 and applied to the set and reset leads, respectively, of flip-flop 415. The circuit of FIG. 2 develops a pulse train output signal whose average is a sawtooth function of the phase difference between the applied signals. The sawtooth nature of the transfer function may be recognized when it is observed that two applied signals separated by a phase A from each other develop square waves which are similarly separated by phase A at the outputs of amplifiers 411 and 412. The resulting output of flip-flop 415 is a pulse train with each pulse having a width that is a fraction of the pulse train period. The pulse width fraction is equal to the amount by which the phase angle A is removed from $-180°$. The average signal of that pulse train provides a measure of the phase angle A and that average increases linearly from $-180°$ through 0° and up to $+180°$, thus appearing as a sawtooth function.

Figure 3:
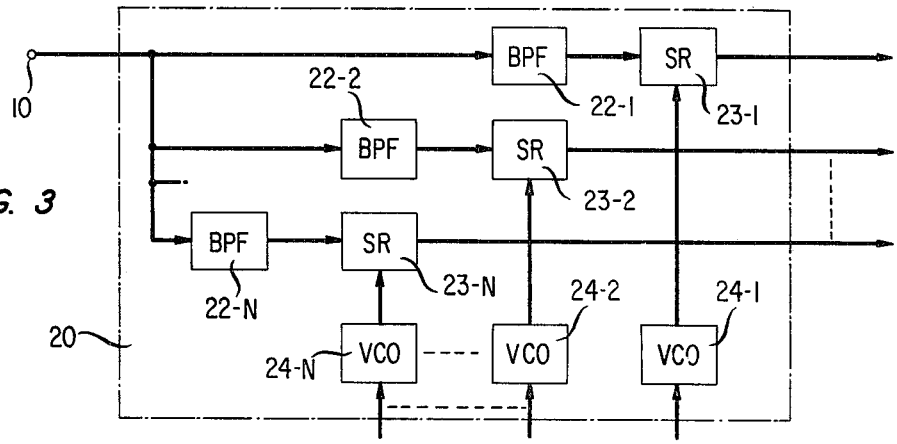
FIGS. 3 and 4 depict alternate implementations for the filter/delay block 20 of the system of FIG. 1.

Filter/delay element 20 may be implemented in a number of ways. Most generally, the delay of each bandpass signal developed by element 20 may be totally unrelated to the delay of any of the other bandpass signals. To achieve such independence of delay, it is most advantageous to first separate the signal of terminal 10 into individual bandpass signals and to then delay each signal. Such capability is offered by the circuit of FIG. 3 where bandpass filters 22-1, 22-2, . . . 22-N are connected to terminal 10, developing a plurality of bandpass signals. The output signal of each bandpass filter **22-*i* is connected to a shift register 23-*i* ($i=1,2 \ldots N$) and the output signals of the shift registers comprise the output signals of element 20. Shift registers are selected for implementation of the variable delay in the FIG. 3 circuit because delay is easily controlled in shift registers by controlling the length of the shift register and the frequency of the signal clocking the shift register. It is more convenient, generally, to dynamically control the frequency of the clock rather than the length of a shift register. Thus, FIG. 3 depicts voltage controlled oscillators (VCOs) 24-1, 24-2, . . . 24-N which are responsive to control signals applied to element 20 and which develop clock signals that are respectively applied to shift registers 23-1, 23-2, . . . 23-N. The control signals affecting the above-described VCOs are the control signals of bus 60 which emanate from signal combiner element 40**.

It may be noted at this point that all circuits in the FIG. 1 system are depicted as being analog but that, at first blush, shift registers **22-*i* require digital circuits. In fact, registers 22-*i*** may be implemented with CCDs (Charge Coupled Devices) which can sustain pulsed signals of different analog amplitudes. Therefore, all that is required is a sampling of the analog signals at the input of the shift registers and a low-pass filter at the output of shift registers.

Figure 4:
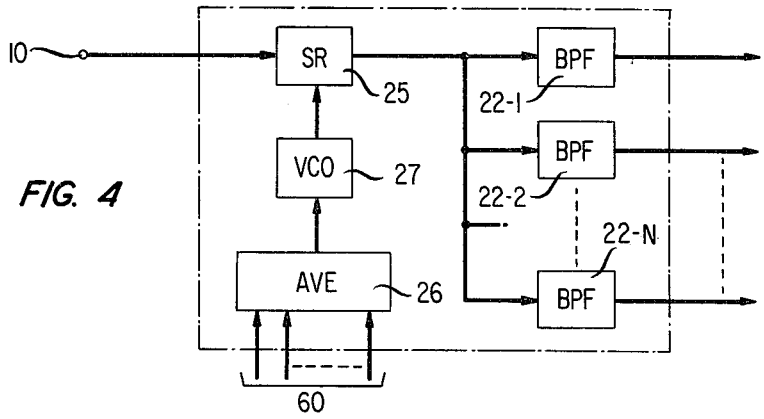

In situations where the direct signal is much stronger than the reflected signals, there is a strong coherence between the signal of one microphone and the delayed signal of the other microphone. In such circumstances, a single delay element applied directly to the signal of terminal 10 may be employed. Such a filter/delay element 20 is shown in FIG. 4 where a shift register 25 is interposed between terminal 10 and the bank of bandpass filters 22-1, 22-2, . . . 22-N. Shift register 25 is also controlled with a VCO (27), but the control signal affecting the VCO 27 is a signal which is proportional to the average of the control signals present on bus 60. This average signal is developed in averaging circuit 26 which is interposed between bus 60 and VCO 27.

It was indicated above that to obtain a good measure of the correlation between the signals applied to correlator circuit 40-1, the fixed and slowly varying phase differences must be removed and that, therefore, bandpass filter (42-1) is required. The need for such a bandpass filter and the accompanying rectifier and low-pass filter circuits (43-1 and 44-1) is eliminated with the phase detector circuit illustrated in FIG. 5.

Figure 5:
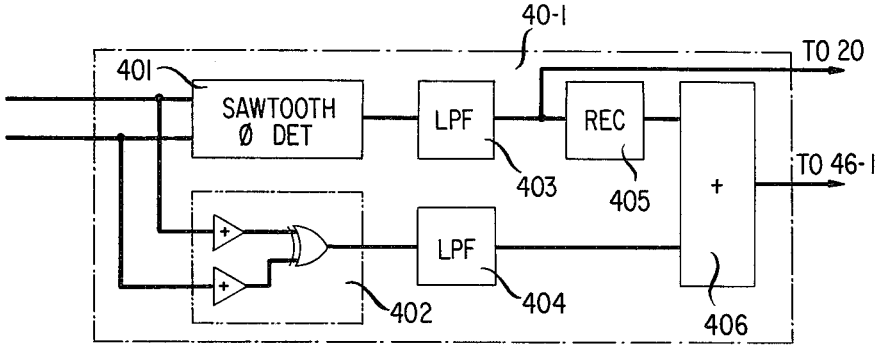

In FIG. 5, the signals applied to correlator circuit 41-1 are applied to a sawtooth phase detector (such as shown in FIG. 2) 401 and to a triangular phase detector 402. Triangular phase detector 402, as shown in FIG. 5, is implemented by amplifying both input signals to the point of amplifier saturation (developing thereby square waves) and by applying the resulting square waves to an Exclusive OR gate. The output signal of the Exclusive OR gate is a pulse train whose average is maximum when the phase angle A between the signals is zero, is linearly reduced with increased (or decreased) phase angle, and reaches a minimum when the phase angle A is $\pm 180°$. The required averages of the signals developed by detectors 401 and 402 are obtained with low-pass filters 403 and 404, respectively. The magnitude of low-pass filter 403 is developed in full-wave rectifier circuit 405 and the output signals of rectifier circuit 405 and of low-pass filter 404 are combined in adder circuit 406. Adder circuit 406 develops the output signal which is applied to elements 46-1; while the output signal of sawtooth phase detector 401, as in the circuit of FIG. 2, is applied to low-pass filter 47-1 to develop the required control signal. A perusal of the output signal of the FIG. 5 circuit reveals that the output signal is insensitive to slow variations in angle A and that in the presence of only fixed or slowly varying phase differences, the output of adder 406 is maximum. When reverberant signals are present, however, the average signals of both phase detectors (401 and 402) is zero and, therefore, the output signal of adder 406 is also zero.

What is claimed is:

1. An analog dereverberation system comprising:

first filter/delay means for developing a first plurality of variably delayed analog bandpass signals in response to a first input signal and a control signal;

second filter/delay means for developing a second plurality of delayed analog bandpass signals in response to a second input signal;

a plurality of correlator means responsive to corresponding signals of said first and second pluralities of bandpass signals for developing a plurality of nonreverberant bandpass signals and for developing said control signal; and means for adding said plurality of nonreverberant bandpass signals to form a single analog nonreverberant signal.

2. The apparatus of claim 1 wherein said first filter/delay means comprises:

a bank of bandpass filters equal in number to said first plurality of bandpass signals responsive to said first input signal; and a bank of delay elements equal in number to said first plurality of bandpass signals, with each of said delay elements being connected to the output of a different one of said bandpass filters.

3. The apparatus of claim 2 wherein each of said bandpass filters covers a different frequency band, and wherein said bank of bandpass filters covers the entire frequency band of said first input signal.

4. The apparatus of claim 3 wherein said frequency bands of said bandpass filters are equal.

5. The apparatus of claim 3 wherein said frequency bands of said bandpass filters overlap.

6. The apparatus of claim 2 wherein said delay elements comprise:

CCD shift registers; and voltage controlled oscillator means responsive to said control signal for effecting the frequency of said oscillator means.

7. The apparatus of claim 1 wherein said first and said second filter/delay means each comprise:

a delay element responsive to the respective input signal; and a bank of filters, each connected to the output terminal of said delay element.

8. The apparatus of claim 1 wherein each correlator means of said plurality of correlator means is responsive to one preselected bandpass signal of said first filter/delay means and to a bandpass signal of said second filter/delay means having a bandpass corresponding to the bandpass of said preselected bandpass signal of said first filter/delay means comprising:

a sawtooth phase detector responsive to the input signals of said correlator means for developing a signal whose average amplitude is related to the phase difference between said input signals of said correlator means;

a first low-pass filter responsive to said sawtooth phase detector for developing a signal forming a part of said control signal;

a bandpass filter responsive to said sawtooth phase detector;

a rectifier responsive to said bandpass filter;

a second low-pass filter responsive to said rectifier;

combiner means for developing a sum of said input signals of said correlator means; and amplitude control means responsive to said second low-pass filter, for effecting the amplitude of the signal developed by said combiner means and for developing thereby a nonreverberant bandpass signal belonging to said plurality of nonreverberant bandpass signals.

9. An analog dereverberation system responsive to signals from two microphones comprising:

filter/delay means responsive to the signals of said two microphones for time shifting the signal of one of said two microphones with respect to the signal of the other of said two microphones under control of a shift control signal and for developing a plurality of bandpass signals from the time shifted signal of said one of said two microphones and from the signal of the other of said two microphones;

means for adding corresponding bandpass signals of said one microphone and said other microphone to develop added bandpass signals;

means responsive to said plurality of bandpass signals for developing said time shift control signal and a gain control signal;

means for effecting the amplitudes of said added bandpass signals in accordance with said gain control signal to develop gain modified bandpass signals; and means for combining said gain modified bandpass signals to form a single nonreverberant signal.

* * * * *